US005623736A

United States Patent [19]

Soltani et al.

[11] Patent Number: 5,623,736

[45] Date of Patent: Apr. 29, 1997

[54] MODULAR INFLATABLE/AIR FLUIDIZED BED

[75] Inventors: Sohrab Soltani, Charleston; James J. Romano; Timothy Perez, both of James Island, all of S.C.

[73] Assignee: Suport Systems, International, Charleston, S.C.

[21] Appl. No.: 353,053

[22] Filed: Dec. 9, 1994

[51] Int. Cl.[6] ..... A47C 27/08; A47C 27/10

[52] U.S. Cl. ..... 5/689

[58] Field of Search ..... 5/450, 453, 455, 5/469, 912, 914, 11, 611, 310, 400, 201; 248/188.2

[56] References Cited

U.S. PATENT DOCUMENTS

| | | | |
|---|---|---|---|
| 2,933,850 | 4/1960 | Martin | 248/188.2 |
| 4,319,370 | 3/1982 | Robinson | 5/201 |
| 4,768,250 | 9/1988 | Kato | 5/469 |
| 4,944,060 | 7/1990 | Peery et al. | 5/455 |
| 4,986,738 | 1/1991 | Kawasaki et al. | 417/304 |
| 5,036,559 | 8/1991 | Hargest | 5/453 |
| 5,243,723 | 9/1993 | Cotner et al. | 5/455 |
| 5,320,187 | 6/1994 | Pressley et al. | 173/15 |
| 5,454,399 | 10/1995 | Kazakis et al. | 137/596.16 |

*Primary Examiner*—Rodney M. Lindsey
*Assistant Examiner*—Robert G. Santos
*Attorney, Agent, or Firm*—Arnold, White & Durkee

[57] ABSTRACT

The invention is a modular inflatable/air fluidized patient bed suitable for in-home use. The bed includes a double walled, molded plastic base formed from two pedestals and a connecting midsection. A blower compartment containing the electrical and mechanical components needed to operate the bed is formed in one of the pedestals. The bed optionally includes a plurality of block-shaped spacers that can be positioned under the pedestals to increase the height of the bed. A series of pilot operated check valves are provided in the air lines leading to the inflatable components. If air flow is interrupted, the check valves close to maintain the air in the inflatable components and prevent them from deflating.

18 Claims, 5 Drawing Sheets

MODULAR INFLATABLE/AIR FLUIDIZED BED

BACKGROUND

The present invention relates to inflatable and air fluidized support surface beds for patients. More particularly, the present invention relates to a modular fluidized and inflatable bed which can easily be transported and assembled for in-home use.

Numerous types of inflatable patient support surfaces have been proposed to support patients. One generic configuration of such a support system in use today includes a plurality of transverse air bags extending across the width of the bed support surface. A plurality of such bags are arranged in parallel to form either a part or the entirety of the patient support surface. As is well known relative to such beds, a blower supplies air through a manifolding system to each of the air bags. This system includes a controller, such as a microprocessor controller, which operates a plurality of valves to control the airflow to sets of one or more of the air bags forming "zones" of the bed.

One of the problems associated with inflatable beds is depressurization that occurs when there is a loss of power. When the air supply is cut off, the inflatable bags deflate and the patient sinks to the hard support surface beneath the bags. In a hospital setting, this problem is minimized because of auxiliary power systems. However, homes do not generally have auxiliary power systems and battery backups can significantly increase the weight and cost of a bed.

Air fluidized beds have also been used as patient support systems. In this type of bed, a fluidizable medium such as tiny spheres formed of glass, ceramics or silicon, is contained within a suitable support means and is fluidized by air passing therethrough to support the patient. In a common design, the fluidizable medium is supported by a diffuser board which is permeable to air but impermeable to the fluidizable medium. Retaining means which are impermeable to air are positioned around the outer edges of the diffuser board. A flexible cover sheet encloses the fluidizable medium and is permeable only to air flow. In an alternative embodiment, the fluidizable medium is contained within a plurality of discreet fluidizable cells positioned on a suitable diffuser board.

Fluidized beds provide excellent support for a patient and help prevent the formation of bed sores because of the equal distribution of pressure. Additionally, these beds are well suited for the treatment of patients with skin grafts because they do not produce high shear, frictional forces when a patient moves on the bed.

One of the problems associated with fluidized patient support services is the weight of the fluidizable medium. The weight of this material in addition to the blower and other controls necessary to operate the bed, make these types of beds relatively heavy and difficult to move.

While many different types of fluidized and inflatable beds have been developed for use in hospitals, many of those designs are not suitable for home use by patients with chronic illnesses. One of the primary difficulties is the size and weight of the beds. Accordingly, it would be a significant advancement in the art to provide an inflatable and fluidized bed which was modular so that it could easily be transported and set up for in-home use. Such a bed is disclosed and claimed herein.

SUMMARY OF THE INVENTION

The present invention provides a modular inflatable/air fluidized bed assembly which is suitable for in-home use.

Because of its modular, compact design, it can easily be transported and set up.

The bed includes a base which is formed from a sturdy but light weight material such as plastic. In the preferred embodiment, the base is formed from rotomolded high density polyethylene. The base includes two box shaped pedestals connected at the top by a midsection. In the preferred embodiment, the base is a double walled, unitary structure.

The bed also includes optional spacers which can be used to raise the height of the support surface of the bed. The spacers have the same cross-sectional profile as the pedestals and in the preferred embodiment are about four inches high. One or more spacers can be placed under each pedestal depending upon the desired height of the bed for either patient need or convenience of the care giver.

The top of each spacer includes a raised portion or step that fits within a recess on the bottom of a corresponding pedestal or spacer. These sections interlock to provide a secure means for preventing the bed from sliding off the spacers.

A blower compartment is formed in one of the pedestals of the base. A blower, valves, heater and other electrical and mechanical components for operating the bed are contained within the blower compartment. The double walled construction of the base provides a level of sound insulation to isolate noise from the blower and the other components in the blower compartment.

An upper frame assembly is positioned on top of the base. The upper frame assembly includes a diffuser board for supporting a fluidizable medium which forms a portion of the patient support surface. In the preferred embodiment, the diffuser board is formed from high density polyethylene (HDPE) and can easily be cleaned and disinfected. The upper frame assembly also includes an articulated headplate assembly which can be raised and lowered to raise and lower a patient's head. The upper frame assembly is detachably mounted on top of the base.

A plurality of inflatable cells are positioned on top of the headplate assembly. These cells are connected through a suitable manifold system and tubing to the blower and pressure control valves located in the base. In the preferred embodiment, a pair of stacked, inflatable rings are also positioned on the upper frame assembly around the diffuser board to contain the fluidizable medium.

In the preferred embodiment, the inflatable cells are divided into two zones. The pressure in each zone is controlled by a pressure control valve located in the blower compartment. A pressure control valve is also used to control the pressure in each inflatable ring. The air pressure in the lower ring is maintained at a higher level than the air pressure in the upper ring.

Pilot operated check valves are positioned in the tubing which runs from the pressure control valves to the inflatable cells and rings. In the event of a power failure or other occurrence that interrupts the flow of air to the cells and rings, the check valves immediately close to prevent air from escaping and thus maintain the cells and rings in their inflated state.

The bed also includes a suitable headboard, footboard and side rails to protect and assist in moving the patient. These elements are detachably mounted to the upper frame assembly.

In the preferred embodiment, a microprocessor based control panel and display is mounted on the foot board. The control panel includes means for adjusting the pressure in the various portions of the bed, means to adjust the air temperature and means to raise and lower the headplate.

DETAILED DESCRIPTION OF THE PREFERRED EMBODIMENTS

The present invention provides a modular inflatable and fluidized bed assembly that is easy to transport and install. Thus, the present invention provides a unique patient bed that is particularly suitable for in-home use. The invention is best understood by reference to the following description and attached drawings taken in conjunction with the claims of this application.

Figure 1:
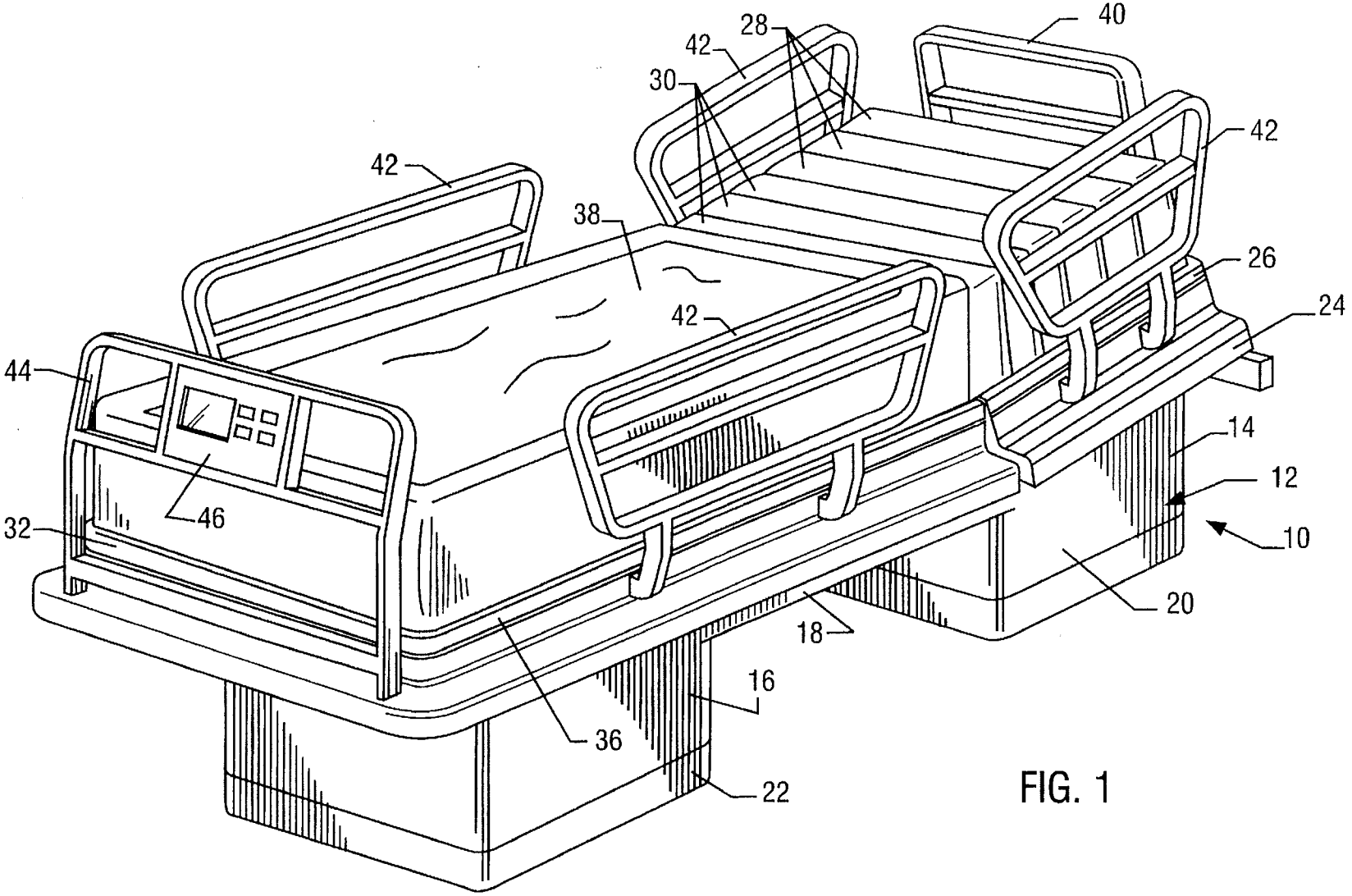
FIG. 1 is a perspective view of a preferred embodiment of the present invention.

Referring first to FIG. 1, a bed constructed in accordance with the present invention is generally designated at 10. Bed 10 includes a base 12 formed from a first box shaped pedestal 14, a second box shaped pedestal 16, and a connecting midsection 18. In the preferred embodiment, the base is formed from a sturdy, light weight plastic material such as high density polyethylene. It can be formed by any one of a number of common techniques known to those skilled in the art of plastics molding. In the preferred embodiment, the base is rotomolded and is formed as a double walled, unitary body.

The bed also includes a plurality of block-shaped spacers 20 and 22 which can be placed under pedestals 14 and 16 respectively to increase the height of bed 10. While a single pair of spacers 20 and 22 have been illustrated, it will be apparent to those skilled in the art in view of the teachings of this application that additional pairs of spacers can be added to further increase the height of bed 10.

An upper frame assembly 24 is positioned on top of base 12. Upper frame assembly 24 includes an articulated headplate 26 which can be raised and lowered to raise and lower a patient's head. Headplate 26 is positioned over first pedestal 14.

A plurality of inflatable cells 28 and 30 designed to support the head and upper torso of a patient are positioned on top of headplate 26. These cells are formed from a material impermeable to air and are connected through suitable manifold systems and tubing to a blower and pressure control system located in pedestal 14 of base 12 as discussed further below. Upper frame assembly 24 also includes a fluidized bed portion 32 for supporting the lower portion of a patient's body with a fluidizable medium which forms a portion of the patient support surface. A pair of inflatable rings 34 and 36 (see FIG. 2) are positioned around the edge of fluidized bed portion 32 and form part of the containment system for the fluidizable medium. Rings 34 and 36 are also formed from a material impermeable to air.

An air permeable sheet 38 is secured to upper frame assembly 24 to cover and contain the fluidizable medium. Suitable means for fastening sheet 38 to assembly 24 are known to those skilled in the art. A preferred method for securing sheet 38 to assembly 24 is disclosed in pending, commonly owned U.S. patent application Ser. No. 08/078,447 filed Jun. 15, 1993, entitled Patient Support System Fastening Device and Method. The teachings of that application are incorporated herein by reference.

Bed 10 also includes a headboard 40, a plurality of sideboards 42 and a footboard 44. In the preferred embodiment, these elements are detachably mounted to upper frame assembly 24.

A control panel and display 46 is mounted on footboard 44. Control panel 46 is used to raise and lower headplate 26, control the air pressure in inflatable cells 28 and 30 as well as inflatable rings 34 and 36, and to control the temperature of the fluidizable medium.

Figure 2:
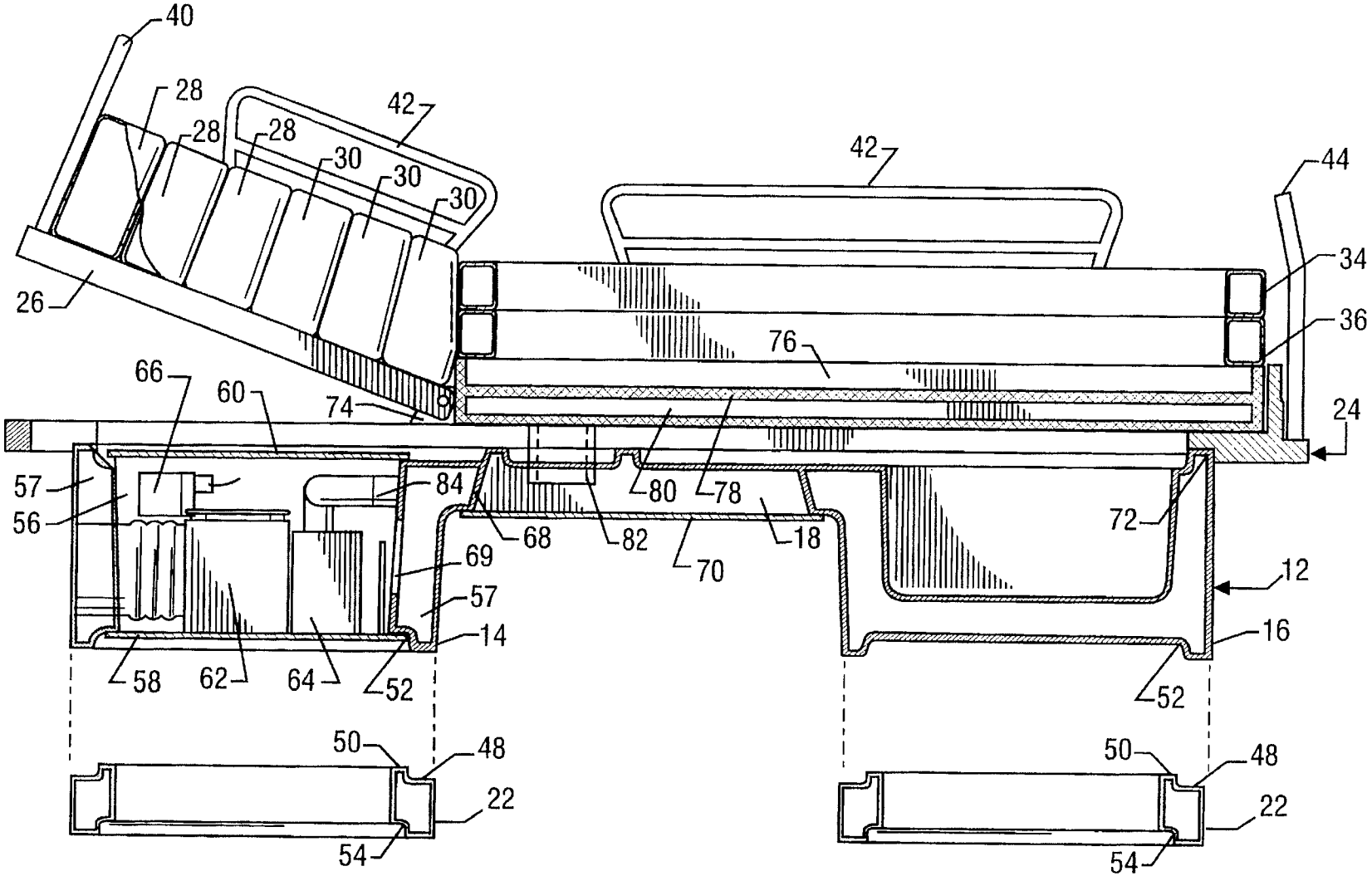
FIG. 2 is a cross-sectional view, partially exploded, of the embodiment of FIG. 1 taken along lines 2—2.
Figure 3:
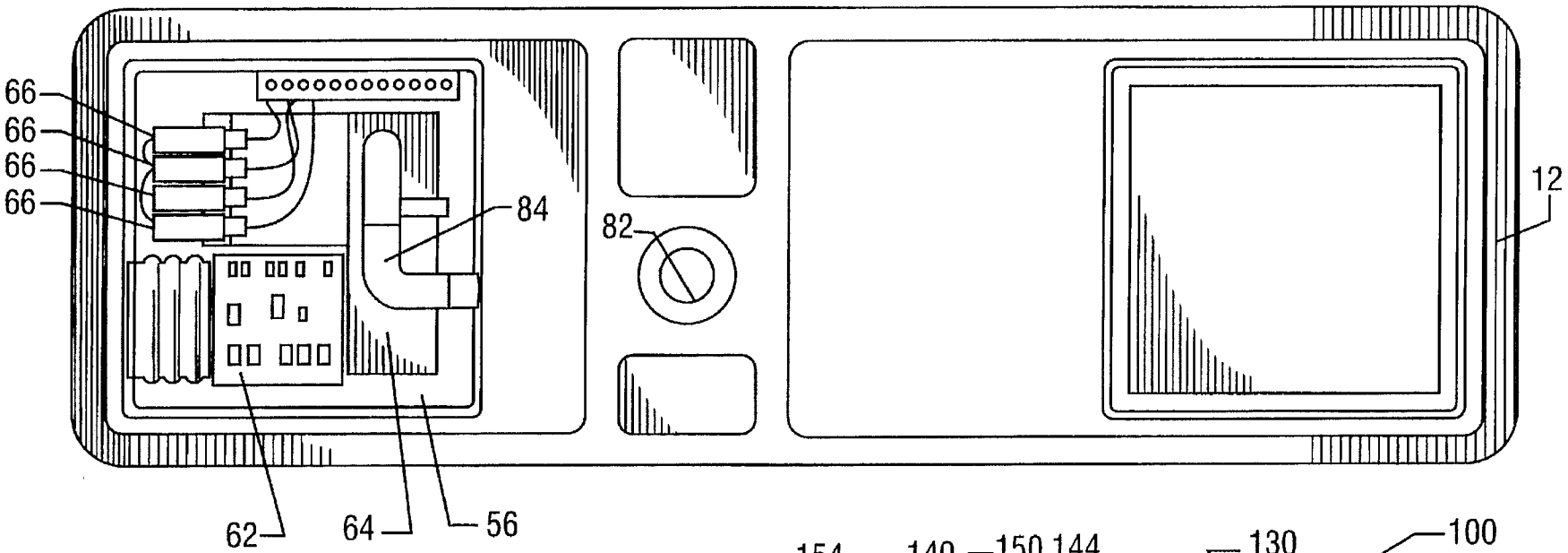
FIG. 3 is top plan view of the base of the embodiment of FIG. 1 with the blower compartment cover removed.

Reference is next made to FIG. 2 which illustrates bed 10 is cross-section to provide greater detail of its construction. Spacers 20 and 22 include a recess 48 around their upper periphery which forms a step 50 on top of the spacers. Step 50 is sized to correspond with a recess 52 formed in the bottom of pedestals 14 and 16. Thus, when spacer 20 is placed under pedestal 14, it fits in mating relationship and does not allow pedestal 14 to slide off of the top of spacer 20. A recess 54, similar to recess 52, is formed in the bottom of spacers 20 and 22. Accordingly, a plurality of spacers can be stacked on top of one another to adjust the height of bed 10.

A blower compartment 56 is formed within pedestal 14. Blower compartment 56 includes a baseplate 58 and a cover 60. The sides of blower compartment 56 are formed by the walls of pedestal 14.

Most of the major electrical and mechanical components needed to operate bed 10 are contained within blower compartment 56. These include a blower/heat exchanger assembly 62, a heater 64, and pressure control valves 66. The space 57 between the double walls of pedestal 14 provides sound insulation against noises from the blower and the other components located in compartment 56.

An aperture 68 is formed in the bottom of midsection 18 to provide an air inlet for blower/heat exchanger assembly 62. Because of the sealed, double walled construction of base 12 the air inlet can be located in essentially any portion of base 12. Apertures, such as aperture 69, are formed in the interior walls of base 12 to permit air flow to pass from aperture 68 to the air intake of assembly 62 located in blower compartment 56. An air filter 70 is placed over aperture 68 to clean the incoming air.

A recess 72 is formed in the bottom of upper frame assembly 24 to correspond to the top of base 12. Accordingly, upper frame assembly 24 sits on top of base 12 in mating relationship after assembly.

Upper frame assembly 24 is similar in construction and operation to the patient support systems disclosed in U.S. Pat. Nos. 4,914,760 and 4,942,635, the teachings of which are incorporated herein by reference for all purposes.

Inflatable cells 28 and 30 are positioned on headplate 26 which is connected to upper frame assembly 24 by a suitable hinge 74. The construction and operation of inflatable cells 28 and 30 is well known to those skilled in the art. In the preferred embodiment, cells 28 and 30 are grouped into two zones as discussed further below.

The fluidized bed portion 32 of upper frame assembly 24 includes a diffuser plate 76 which is permeable to air but impermeable to the fluidizable medium which, in the preferred embodiment, comprises tiny glass beads or microspheres. A perforated support plate 78 is positioned beneath diffuser plate 76 to provide additional support and strength. A plenum 80 is formed in upper frame assembly 24 beneath diffuser plate 76 and perforated support plate 78. Plenum 80 is connected by inlet 82 to pipe 84 in blower compartment 56 by suitable piping (not shown) which conducts heated air to the fluidized bed.

Inflatable ring 36 is positioned around the outer periphery of diffuser plate 76 with inflatable ring 34 positioned on top of inflatable ring 36. Ring 34 is connected to ring 36 which is in turn connected to diffuser plate 76 so as to provide a containment system for the fluidizable medium which is placed on top of diffuser plate 76. Suitable means for fastening rings 34 and 36 to each other as well as securing ring 36 to diffuser plate 76 are well known to those skilled in the art.

Figure 4:
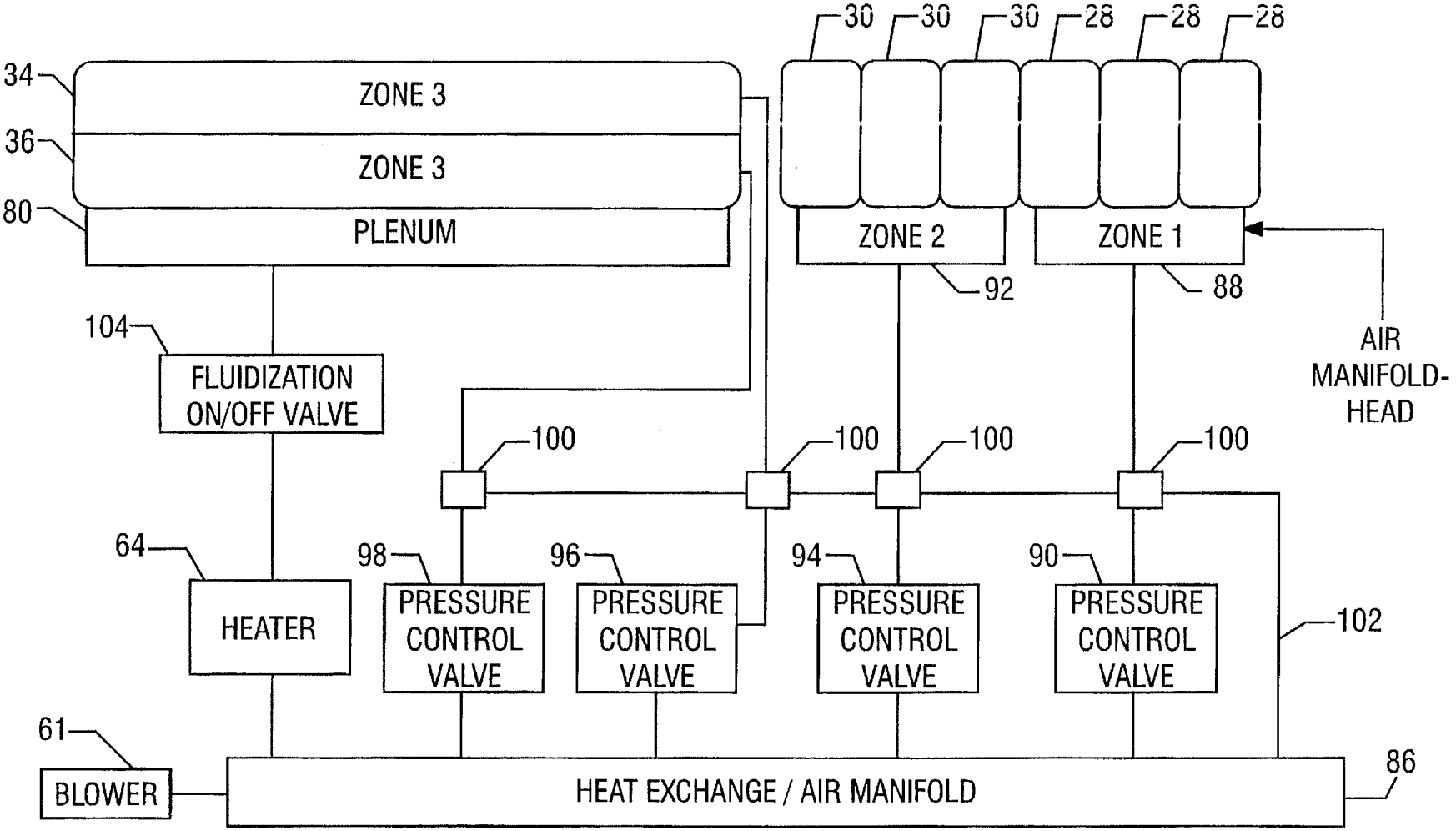
FIG. 4 is a air flow block diagram of a preferred embodiment of the present invention.

Reference is next made to FIG. 4 which is an air flow block diagram of a preferred embodiment of the present invention. Blower 61 supplies air to a heat exchanger/air manifold 86 which distributes the air to the various portions of the bed.

Inflatable cells 28 are connected together by an air manifold 88 to form a first zone. This zone is maintained by means of pressure control valve 90 at a pressure sufficient to support a patient's head. Inflatable cells 30 are connected by a second air manifold 92 to form a second zone. Pressure control valve 94 maintains the pressure in zone 2 at a level suitable to support the upper torso of a patient.

Pressure control valve 96 controls the pressure in a third zone which corresponds to inflatable ring 34. The pressure in inflatable ring 34 is adjusted to provide proper support according to the size and weight of the patient since a portion of the ring is positioned under the patient's back. Pressure control valve 98 controls the pressure in a fourth zone corresponding to inflatable ring 36 which, in the preferred embodiment is maintained at a higher pressure than inflatable ring 34. In one embodiment, the pressure in ring 36 is about 5 inches of water (0.18 psi) greater than the pressure in ring 34.

One of the problems associated with the inflatable portions of prior beds was that the inflatable cells would deflate and cease supporting the patient if there was any interruption in the air supply from the blower. This problem is alleviated in the present invention by providing a pilot-operated check valve 100 in each pressure line downstream of pressure control valves 90, 94, 96 and 98. The pilot pressure to check valves 100 is provided by supply line 102 connected to heat exchanger air manifold 86. Thus, if there is any interruption of air flow from blower 61, the pilot pressure to check valves 100 is removed which causes them to close and thus maintain the air pressure within zones 1–4.

Air from heat exchanger/air manifold 86 is also conducted through suitable piping to the fluidizable medium. This air passes through heater 64 and its flow into plenum 80 is preferably controlled by fluidization on/off valve 104. In an alternative embodiment, valve 104 is eliminated and air flow to the fluidizable medium is controlled by turning blower 61 on and off. In the preferred embodiment heater 64 is located within heat exchanger/air manifold 86.

Figure 5:
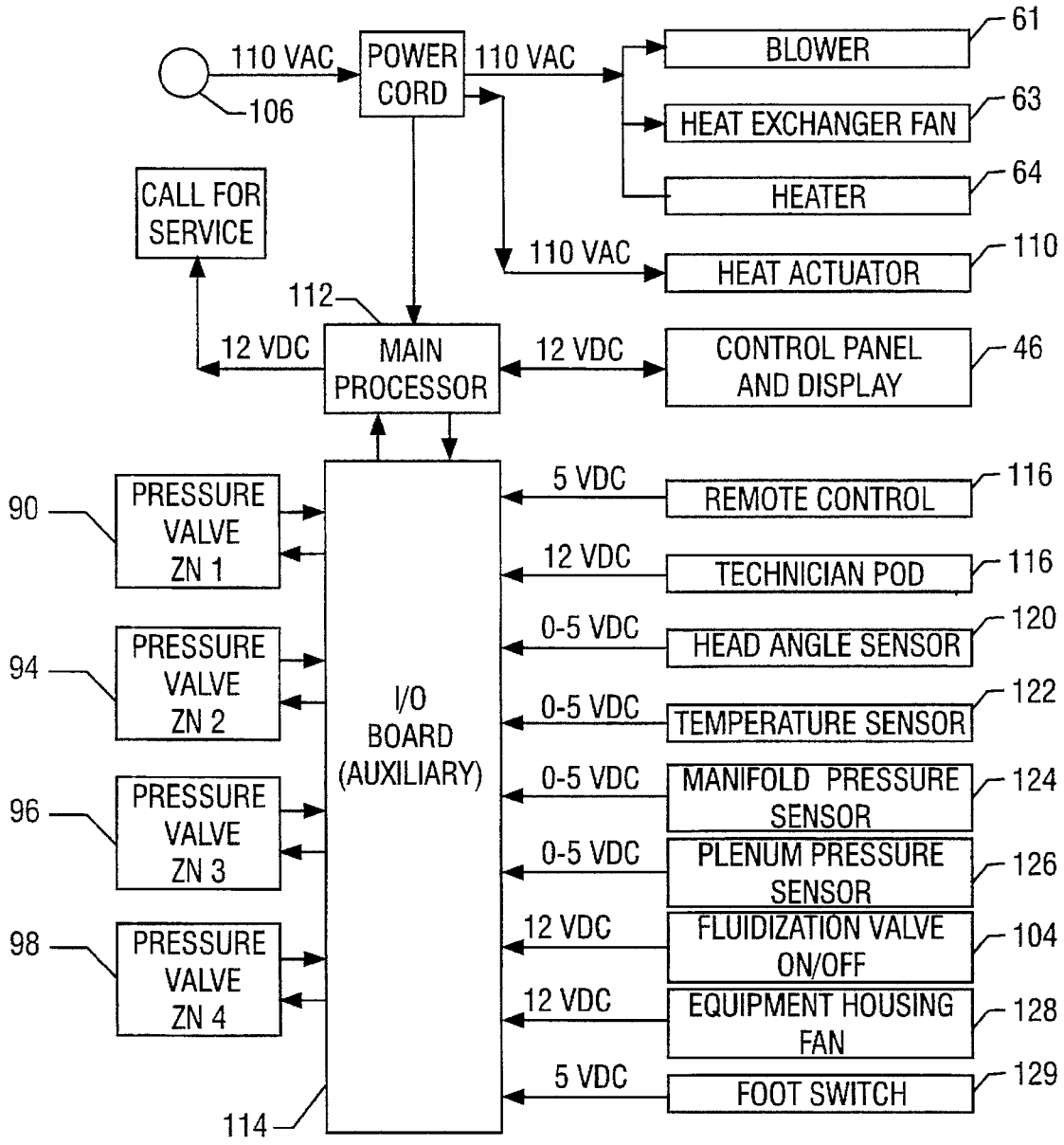
FIG. 5 is a general electrical block diagram of a preferred embodiment of the present invention.

Reference is next made to FIG. 5 which is a general electrical block diagram of a preferred embodiment of the present invention. Power is supplied to bed 10 from a suitable power source 106. The electrical power is distributed through a power card 108 to the other components of the electrical system. Power is distributed to blower 61, a heat exchanger fan 63 and heater 64. Power is also supplied to head actuator 110 which raises and lowers headplate 26.

Power card 108 also supplies power to main processor 112 which controls the functioning of bed 10. Processor 112 controls pressure control valves 90, 94, 96 and 98 through I/O board 114. Operator interaction with main processor 112 is accomplished through control panel and display 46.

Main processor 112 also receives input through I/O board 114 from a remote control 116, a technician pod 118, a head angle sensor 120, a temperature sensor 122, a manifold pressure sensor 124, a plenum pressure sensor 126, optional fluidization on/off valve 104, equipment housing fan 128, foot switch 129 and pressure control valves 90, 94, 96 and 98.

Technician pod 118 can be used during installation and maintenance of bed 10. In the preferred embodiment it is used to monitor the system, update memory in the unit, input patient parameters and perform system diagnostics.

Remote control 116 can be used by a patient to raise and lower headplate 26 and control fluidization of the fluidizable medium.

Figure 6:
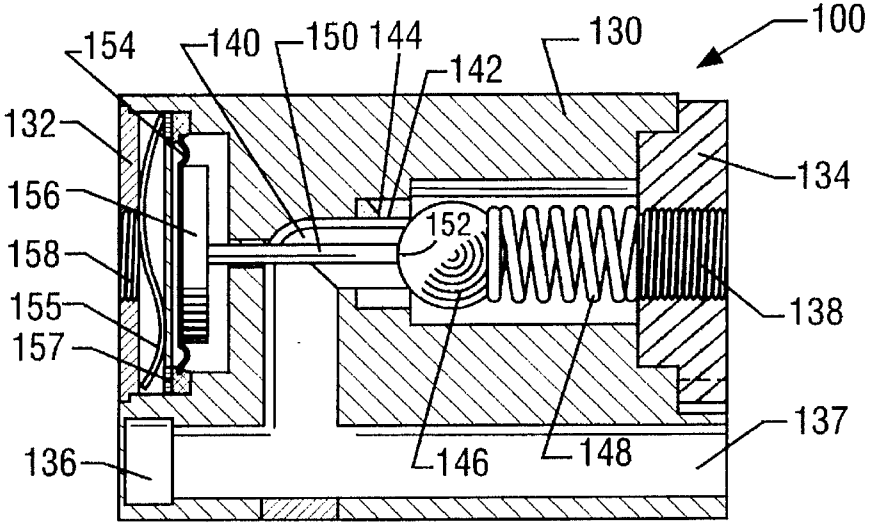
FIG. 6 is a cross-sectional view of a pilot operated check valve used in the preferred embodiment.

Temperature sensor 122 monitors the temperature of the fluidizable medium. If the temperature gets too hot, an alarm is sounded and the system shuts down. Manifold pressure sensor 124 monitors the pressure in heat exchanger/air manifold 86. Plenum pressure sensor 126 monitors the pressure in plenum 80. Reference is next made to FIG. 6 which illustrates a cross-sectional view of a preferred embodiment of the pilot operated check valve 100 of the present invention. Check valve 100 includes a body 130 and end caps 132 and 134 which are sealed to the ends of body 130 by an adhesive, threads or a press fit relationship. An air inlet 136 is formed in an end of passageway 137 in body 130 and an air outlet 138 is formed in end cap 134. The other end of passageway 137 can be plugged or can include a valve for measuring pressure in passageway 137. Inlet 136 and outlet 138 are connected by air passageways 137 and 140.

An annular shaped rubber seat 142 is positioned within recess 144 which forms a portion of air passageway 140. A rubber ball 146 is also positioned within air passageway 140 and engages seat 142 when check valve 100 is in the closed position. A spring 148 positioned between rubber ball 146 and end cap 134 biases ball 146 against seat 142.

A push rod 150 is axially positioned within check valve 100. Push rod 150 has a first end 152 which engages ball 146 to unseat it from seat 142.

A diaphragm 154 is positioned within body 130 of check valve 100 adjacent end cap 132. A wave washer 155 and a circular shim 157 are positioned between end cap 132 and diaphragm 154. Diaphragm 154 engages an enlarged head 156 formed on a second end of push rod 150. A port 158 in end cap 132 is connected to a source of pilot air to operate check valve 100.

In operation, pilot air enters port 158 and pushes against diaphragm 154 causing push rod 150 to unseat ball 146 from rubber seat 142. Thus, air entering through inlet 136 can pass through passageways 137 and 140 and exit through outlet 138. If the pilot air is interrupted for any reason, spring 148 forces ball 146 back into its seated position against seat 142 sealing passageway 140 to prevent air from escaping from the system.

As can be seen from the foregoing, the present invention provides a novel, modular inflatable/air fluidized bed that is suitable for in-home use. While the invention has been described with respect to the presently preferred embodiments, it will be appreciated by those skilled in the art that many modifications and variations may be made to the structures described and illustrated herein without departing from the spirit and scope of the present invention. For example, the number and arrangement of the inflatable zones can be modified. Additionally, the fluidizable medium can also be divided into different zones. Further, the shape and structure of the base of the bed can be modified. Accordingly, it should be readily understood that the structures described and illustrated herein are illustrative only, and are not to be considered as limitations upon the scope of the present invention which is defined by the following claims.

What is claimed is:

1. A bed for supporting a patient comprising:

an inflatable support layer comprising a plurality of inflatable cells to support at least a first portion of a patient's body;

a fluidizable medium contained within a suitable containment system for supporting a second portion of the patient's body;

a frame assembly supporting said inflatable support layer and said fluidizable medium; and a unitary, plastic base for supporting said frame assembly, said base comprising first and second box shaped pedestals, a midsection connecting said pedestals, and a blower compartment formed in one of said pedestals, said blower compartment containing a blower for inflating said support layer and for fluidizing said fluidizable medium.

2. A bed for supporting a patient as defined in claim 1 wherein said base is formed from double walled molded plastic with an air space between said double walls.

3. A bed for supporting a patient as defined in claim 2 wherein said midsection includes an air intake opening and filter for receiving air and conducting it through said air space between said walls to an inlet to said blower.

4. A bed for supporting a patient as defined in claim 1 further comprising a plurality of stackable spacers having a cross-sectional shape essentially the same as a cross-sectional shape of said pedestals, said spacers being positionable beneath said pedestals to raise the height of said bed.

5. A bed for supporting a patient as defined in claim 4 wherein one spacer is placed beneath each pedestal.

6. A bed for supporting a patient as defined in claim 4 wherein two spacers are stackably placed beneath each pedestal.

7. A bed for supporting a patient as defined in claim 4 wherein each spacer includes a raised portion on a top surface thereof which mates with a recessed portion in a bottom surface of a corresponding pedestal or spacer.

8. A bed for supporting a patient as defined in claim 1 wherein said containment system comprises first and second inflatable rings mounted on said frame assembly around the area that supports the fluidizable medium.

9. A bed for supporting a patient as defined in claim 8 wherein said first inflatable ring is positioned on top of said second inflatable ring and wherein the air in said second ring is maintained at a pressure higher than the pressure maintained in said first ring.

10. A bed for supporting a patient as defined in claim 1 wherein said inflatable cells are grouped together into a plurality of zones connected to said blower by tubing, said bed further comprising a pilot operated check valve positioned in the tubing leading to each zone which valve automatically closes when air pressure is interrupted, thus maintaining the air within the inflatable cells.

11. A bed for supporting a patient comprising:

a plurality of inflatable cells grouped into a plurality of zones positioned on a support surface;

a blower and manifold for supplying air to inflate the cells;

tubing which connects the manifold with the plurality of zones;

a plurality of pressure control valves, one of said valves being positioned in said tubing for controlling the pressure in each zone; and a plurality of pilot operated check valves, one of said check valves being positioned in said tubing downstream each pressure control valve which automatically closes when air pressure is interrupted, thus maintaining the air within the inflatable cells.

12. A bed for supporting a patient as defined in claim 11 wherein said pilot operated check valve comprises:

a body having an air inlet and an air outlet connected by an air passageway;

an annular rubber seat positioned in said passageway;

a ball for engaging said seat and occluding said passageway when said valve is in a closed position;

a push rod having a first end for unseating said ball from said seat when said valve is in an open position;

a diaphragm adjacent a second end of said push rod; and an inlet port for admitting pilot pressure against said diaphragm.

13. A bed for supporting a patient as defined in claim 12 wherein said ball is formed of rubber.

14. A bed for supporting a patient comprising:

an inflatable support layer comprising a plurality of inflatable cells to support at least a first portion of a patient's body;

a frame assembly supporting said inflatable support layer; and a base for supporting said frame assembly, said base being formed from double walled, molded plastic with an air space between said walls, said base including a blower compartment containing a blower for inflating said inflatable cells.

15. A bed for supporting a patient as defined in claim 14 wherein said base is formed from two box shaped pedestals and a midsection connecting said pedestals.

16. A bed for supporting a patient as defined in claim 14 further comprising an air intake opening formed in a first wall of said base and an air inlet formed in a second wall of said base in said blower compartment whereby air for said blower enters through said intake and passes through said air space between the walls of said base to said inlet in said blower compartment.

17. A bed for supporting a patient as defined in claim 16 further comprising a filter positioned over said air intake opening.

18. A bed for supporting a patient as defined in claim 14 further comprising a plurality of stackable spacers having a raised surface on a top surface thereof which mate with a corresponding recess formed in a bottom surface of said base whereby said spacers can be placed under said base to raise the height of said bed.

* * * * *

UNITED STATES PATENT AND TRADEMARK OFFICE

CERTIFICATE OF CORRECTION

| | | |
|---|---|---|
| PATENT NO. | : | 5,623,736 |
| DATED | : | April 29, 1997 |
| INVENTOR(S) | : | Sohrab Soltani, James J. Tomano and Timothy Perez |

It is certified that error appears in the above-identified patent and that said Letters Patent is hereby corrected as shown below:

Title page, item [73], line 1, delete "Suport" and insert -- Support-- therefor.

Signed and Sealed this

Twelfth Day of August, 1997

Bruce Lehman

*Attest:*

BRUCE LEHMAN

*Attesting Officer*

*Commissioner of Patents and Trademarks*